United States Patent [19]

Maldina et al.

[11] Patent Number: 4,957,122

[45] Date of Patent: Sep. 18, 1990

[54] DEVICE FOR THE ELECTROSTATIC PERFORATION OF WEBS OF PAPER

[75] Inventors: Paolo Maldina, Bologna; Maurizio Piana, Casalecchio di Reno; Antonio V. Suzzi, Bologna, all of Italy

[73] Assignee: Sasib, S.p.A., Bologna, Italy

[21] Appl. No.: 529,851

[22] Filed: Sep. 6, 1983

[30] Foreign Application Priority Data

Sep. 15, 1982 [IT] Italy ..... 12621 A/82

[51] Int. Cl.[5] ..... A24C 5/00; A24C 5/60

[52] U.S. Cl. ..... 131/281; 219/383; 219/384

[58] Field of Search ..... 131/281; 219/383,384

[56] References Cited

U.S. PATENT DOCUMENTS

| | | | |
|---|---|---|---|
| 3,862,396 | 1/1975 | Machida et al. . | |
| 4,029,938 | 6/1977 | Martin . | |
| 4,035,611 | 7/1977 | Martin et al. . | |
| 4,247,754 | 1/1981 | Baier . | |
| 4,253,010 | 2/1981 | Brown et al. . | |
| 4,278,871 | 7/1981 | Kufeke et al. | 131/281 |

*Primary Examiner*—V. Millin

*Attorney, Agent, or Firm*—Spencer & Frank

[57] ABSTRACT

A device for the electrostatic perforation of webs made of paper or other materials, particularly of the webs used in the manufacture of ventilated cigarettes to constitute the cigarette envelope or the junction band of a cigarette with the respective filter, includes two opposite electrode-carrying heads between which the web passes at least one of the heads is provided with a plurality of individual needle-shaped electrodes arranged substantially perpendicularly to the plane of the web. The individual needle-shaped electrodes are mounted so as to be axially slidable in the respective electrode-carrying head and can be pushed toward the opposite by a pushing force and against the action of an opposing force, until their front ends engage a gauged shim placed between the two to establish the right spacing. In addition to this periodical re-setting of the right spacing for the electrodes, the invention also provides an automatic narrowing of the distance between the heads during the operation of the perforating device, in order to compensate for the wear of said electrodes, until a pre-established minimum distance between the heads is reached.

24 Claims, 4 Drawing Sheets

DEVICE FOR THE ELECTROSTATIC PERFORATION OF WEBS OF PAPER

BACKGROUND AND SUMMARY OF THE INVENTION

This invention relates to devices for the electrostatic perforation of webs made of paper of other materials, particularly of the webs used in the manufacture of ventilated cigarettes, and which may be formed by the paper web which enwraps the tobacco rod to form the envelope or the web of covering material, or "cork", forming the junction band of a cigarette with the respective filter.

Said electrostatic perforating device substantially comprises two opposite electrode-carrying heads being traversed therebetween by a web to be perforated, one of which is provided with a plurality of individual needle-shaped electrodes arranged substantially perpendicularly to the plane of the web and cooperating each with a corresponding individual and co-axially opposite needle-shaped electrode provided on the other head, or with a common plate-shaped electrode provided on said other head.

In the electrostatic perforating devices of the type mentioned above, the electrodes of the two electrode-carrying heads are maintained at different electric potentials and the web advancing at constant speed between the two electrode-carrying heads is perforated by the sparks striking between the individual needle-shaped electrodes of one electrode-carrying head and either the common electrode or the corresponding needle-shaped electrodes of the other electrode-carrying head.

In order to obtain optimum operation of the electrostatic perforating devices of the type described above, the distance between the opposite electrodes of the two electrode-carrying heads must be kept constant within somewhat strict tolerance limits. For this purpose, electrodes made of tungsten or of tungsten-based alloys are used. However, the tips of the individual needle-shaped electrodes wear out quickly, and even with different rates, and the right distance between said electrodes, therefore, must be re-set.

The object of this invention is to provide an electrostatic perforating device of the type described above, wherein the right distance between the electrodes can be re-set periodically, semi-automatically, quickly and exactly with the aid of a calibrated or gauged shim.

This problem is overcome by the invention because the individual needle-shaped electrodes are axially slidably arranged in the respective electrode-carrying head and can be advanced toward the opposite electrode-carrying head by a pushing force and against the action of an opposing force, until their front ends will engage a gauged shim placed between the two electrode-carrying heads, and adapted to establish the right distance between the electrodes of the two electrode-carrying heads.

Preferably, according to an embodiment of the invention, said pushing force is exerted separately on each individual needle-shaped electrode and is obtained specifically by means of a pressurized fluid, for example by means of compressed air. Said opposing force is also exerted preferably separately on each individual needle-shaped electrode and can be constituted, for example, by a frictional resistance tending to maintain the individual needle-shaped electrodes in their positions.

Thus, by merely inserting said gauged shim between the two electrode-carrying heads of the electrostatic perforating device, and then by pushing the individual needle-shaped electrodes, for example by means of said pressurized fluid until their tips will engage said gauged shim, it will be obtained, after said shim has been removed, the exact pre-established distance between the electrodes of said electrode-carrying heads, by means of a periodical, semi-automatic operation for resetting said distance.

When only one electrode-carrying head is provided with needle-shaped electrodes, while the other electrode-carrying head is provided with a single plate-shaped electrode, according to the invention, only the needle-shaped electrodes will be advanced. However, when both the electrode-carrying heads are provided with needle-shaped opposite and co-axial electrodes, the electrodes of both electrode-carrying heads are so designed as to be advanced.

A further object of the invention is to provide an electrostatic perforating device of the type described above, wherein the distance between the electrodes of the two electrode-carrying heads will be kept constant automatically, within pre-established wear limits, during the operation of the device, so as to reduce the frequency of the periodical, semi-automatic operations for resetting the right distance between the needle-shaped electrodes. To achieve this object, the invention provides for an automatic mutual approaching movement of the electrode-carrying heads during the operation of the electrostatic perforating device, through a relative micrometric movement proportional to the increase of the distance between the electrodes, said approaching movement being thus capable of compensating for the wear of said electrodes. This automatic and micrometric mutual approaching movement of the electrode-carrying heads may be either continuous or, preferably, discontinuous and may be obtained either by moving only one electrode-carrying head while the other is kept stationary, or by moving both electrode-carrying heads. The mutual micrometric approaching movement of the electrode-carrying heads to compensate automatically for the wear of the electrodes may be obtained by any suitable means, for example by a cam.

BRIEF DESCRIPTION OF THE DRAWINGS

These and other characteristics of the invention and the advantages resulting therefrom will be more apparent from the following description of an embodiment thereof, diagrammatically shown as a non-limitating example in the accompanying drawings, wherein.

DESCRIPTION OF THE PREFERRED EMBODIMENT

Figure 1:
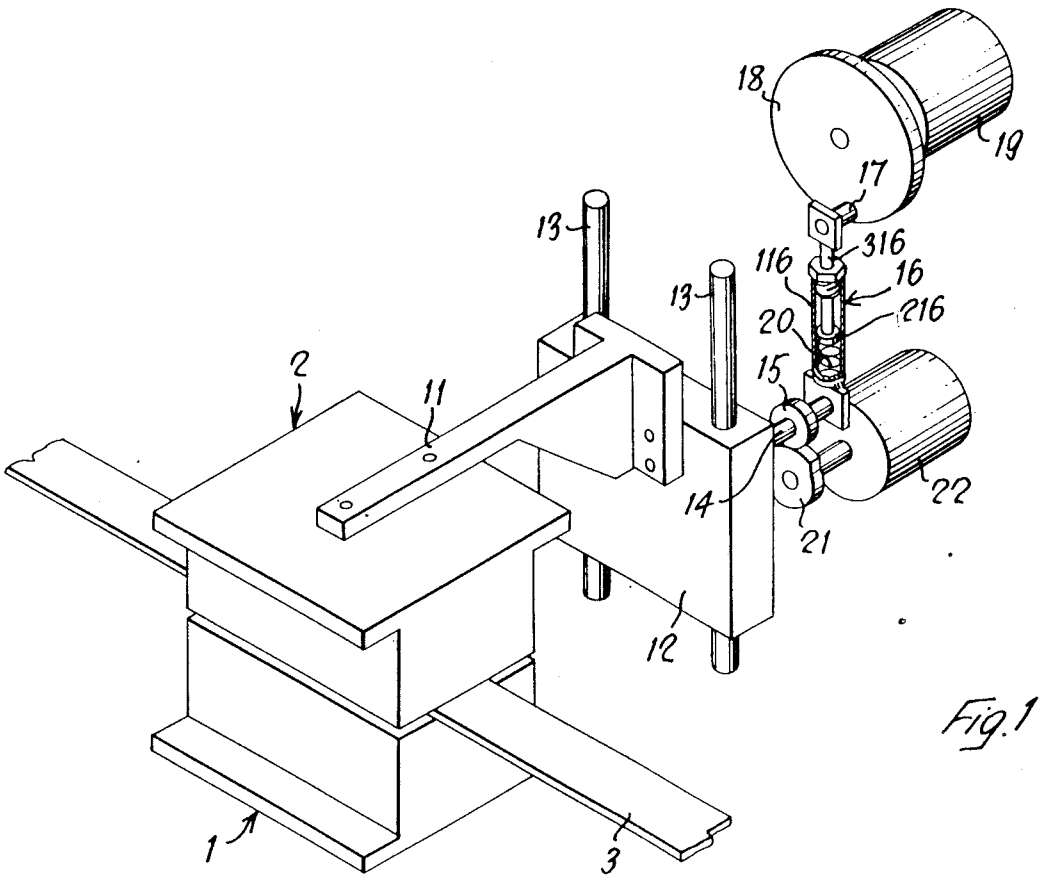
FIG. 1 is a perspective view of an electrostatic perforating device according to the invention, in the operative position thereof.

With reference to the drawings, the numerals 1 and 2 indicate the two opposite electrode-carrying heads of an electrostatic perforating device to be used to perforate a web 3 of paper or similar material, for example a web of covering material wherefrom are obtained—by transverse cutting operations—the junction bands for the ventilated cigarettes and respective filters. In the illustrated embodiment, the electrode-carrying heads are in superimposed relation and, therefore, will be indicated as lower head 1 and upper head 2, though said relation is not limitative of the invention.

Both electrode-carrying heads 1 and 2 are provided with opposite and co-axial needle-shaped electrodes slightly protruding from the planar face of the respective electrode-carrying head 1 or 2 facing toward the opposite electrode-carrying head 2 or 1. In the illustrated embodiment, the pairs of opposite electrodes 4 of the two electrode-carrying heads 1, 2 are arranged in two parallel rows extending in the longitudinal direction of the web 3 passing between the two electrode-carrying heads 1, 2.

Figure 3:
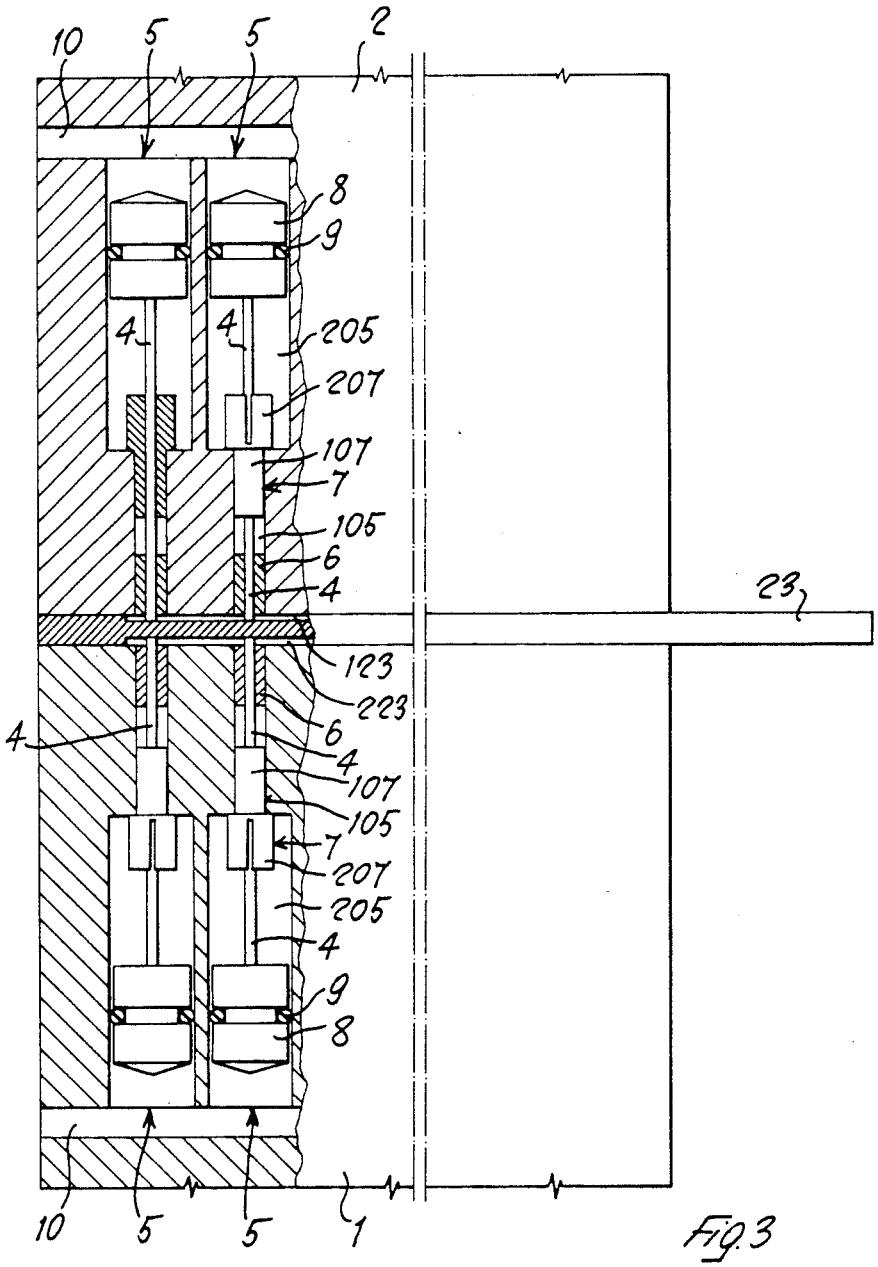
FIG. 3 is a fragmentary sectional view of the two opposite electrode-carrying heads of the device of FIGS. 1 and 2.

Each electrode-carrying head is formed by a block of electrically insulating material provided, for receiving each needle-shaped electrode 4, with a cylindrical bore 5 formed by two different-diameter bores 105 and 205, as shown in the detail view of FIG. 3. Each reduced-diameter bore 105 opens at the planar face of the respective electrode-carrying head 1 and 2 facing toward the opposite electrode-carrying head 2 and 1, and fitted within said reduced-diameter bore 105 in the bore 5 is a small bush 6 of ceramic material wherein the respective needle-shaped electrode 4 is slidably guided with a suitable radial clearance. The front end of the electrode 4 protrudes from the bush 6 and respective bore 5 at said face of the electrode-carrying head. A flow of cooling air fed through conduits (not shown in the drawings) formed in the block of the respective electrode-carrying head passes through the interstice between the electrode 4 and bush 6. Fitted in the opposite inner end of the reduced-diameter bore 105 is the stem 107 of a tubular electrode-carrying clamp 7 having a head portion 207 formed with two diametrically opposed longitudinal slits and accommodated in the larger-diameter portion 205 of the bore 5. In order to clamp the needle-shaped electrode 4 threaded trough the clamp 7, the head portion 207 of the clamp 7 is tightened, when manufactured, in a radial direction perpendicular to the plane comprising the two slits, so as to undergo a permanent deformation to reduce the cross-sectional area of the passage for the electrode 4. The needle-shaped electrode 4 threaded through the electrode-carrying clamp 7 is thus locked in its position by a sufficient frictional force, but it can be slid axially by a suitably strong force acting axially on said electrode.

In the larger-diameter portion 205 of each bore 5 is sealingly slidable a piston 8 made of ceramic material and provided with a sealing ring 9. The piston 8 abuts against the rear end of the respective needle-shaped electrode 4 and may be acted upon by a pressurized fluid supplied into the outer end of the larger-diameter portion 205 of the bore 5 through a manifold conduit formed in the insulating head of the electrode-carrying heads 1 and 2. Said pressurized fluid is formed preferably by compressed air. The supply of compressed air to the manifold conduit 10 of each head 1 and 2 is controlled by a corresponding electrically-operated valve (not shows).

The lower electrode-carrying head 1 is stationary, while the upper electrode-carrying head 2 is movable, that is it can be moved up and down with respect to the lower head. For this purpose, the upper electrode-carrying head 2 is suspended from a bracket 11 which is secured to a skid 12 which is slidable on vertical guide posts 13. Secured to the skid 12 is a horizontal pivot 14 whereon a roller 15 is freely rotatable. The free end of the pivot 14 is journalled in the bottom end of a telescopic connecting rod 16 which can be resiliently collapsed. The other end of the connecting rod 16 is pivotably connected to a crankpin 17 on a crank disc 18 actuated by a reversible electric motor 19. The resilient, telescopic connecting rod 16 comprises, for example, a cylindrical member 116 pivotably connected to the pivot 14 and containing a compression spring 20 pushing outwardly a head member 216 integral with a stem 316 co-axial with the cylindrical member 116 and slidable outwards therefrom through the end thereof opposed to the pivot 14. The stem 316 is pivotably connected to the crankpin 17. By actuating the reversible motor 19 in either direction, said motor will move the skid 12 up and down by means said crankpin 18 and connecting rod 16, thereby moving the upper electrode-carrying head 2 to a raised position away from the stationary lower electrode-carrying head 1 (FIG. 2), and to a lowered operative position, close to the lower electrode-carrying head 1 (FIG. 1).

The lowered operative position of the upper electrode-carrying head 2 is established by the engagement of the idle roller 15, rotatable about the pivot 14 of the skid 12, with a cam 21 actuated by an electric motor 22. In this lowered position of the skid 12 and corresponding lowered operative position of the upper electrode-carrying head 2, the idle roller 15 of the pivot 14 is urged against the cam 21 not only by the weight of the skid 12 and upper head 2, but also by the compression spring 20 of the resiliently collapsible telescopic connecting rod 16, thus ensuring a high-precision engagement.

Figure 2:
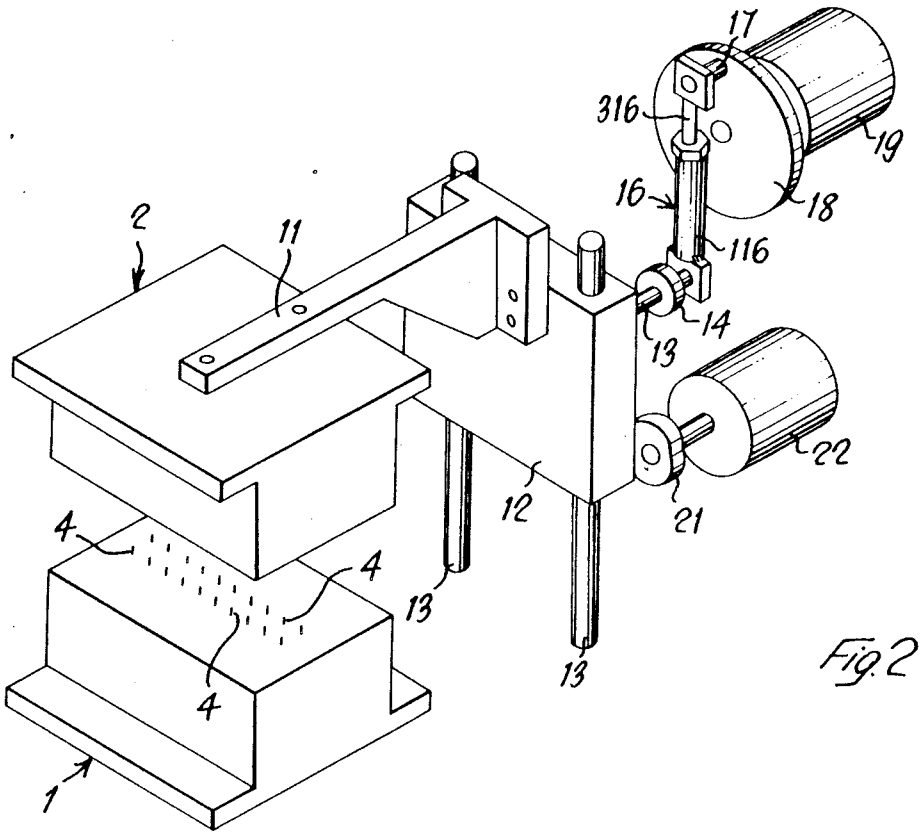
FIG. 2 is a perspective view of the device of FIG. 1, in a stage of the periodical operations for resetting the right distance between the electrodes.

In order to restore periodically and semi-automatically the right distance between the opposite ends of the individual co-axial needle-shaped electrodes 4 of the two electrode-carrying heads 1 and 2, the motor 19 is actuated in such a direction as to cause a quick lifting movement of the skid 12 and, therefore, to move the electrode-carrying head 2 from its lowered operative position of FIG. 1 to its raised position of FIG. 2. In this condition, a gauged shim 23 is arranged on the lower electrode-carrying head 1, said shim being substantially formed by a plate with planar parallel faces, each of which is formed with two rectilinear parallel grooves 123, 223, in register with each other and corresponding to the two rows of pairs of electrodes 4. The thickness existing between the bottom of each groove 123, 223 is equal to the right distance between the front ends of the opposite electrodes 4 of the two electrode-carrying heads 1 and 2.

The motor 19 is then actuated in the opposite direction, whereby it will cause the downward movement of the skid 12 and upper electrode-carrying head 2 until the idle roller 15 on the pivot 14 of the skid 12 will engage a sector of the cam 21 which is concentric with the axis of rotation of said cam 21, as shown in FIG. 1. In this lowered position of the skid 12, the upper electrode-carrying head 2 rests on the lower electrode-carrying head 1 with the intermediary of the gauged shim 23, as shown in FIG. 3. Thereafter, the electrically-operated valves feeding the pressurized fluid to the manifold conduits 10 of the two electrode-carrying heads 1, 2 are opened, preferably sequentially after each other, whereby the pressurized fluid will act on the pistons 8, first on one and then on the other electrode-carrying head 1, 2. The pistons 8 are thus moved toward the gauged shim 23 and push the respective needle-shaped electrodes 4—against the opposing frictional force of the clams 7—toward said gauged shim 23, until the front ends of the electrodes 4 will engage the bottoms of the respective grooves 123, 223, as shown in FIG. 3. The upper electrode-carrying head 2 is then lifted again, the gauged shim 23 is removed and the electrode-carrying head 2 is lowered again until the idle roller 15 on the pivot 14 will engage again the circular concentric sector of the cam 21. In this position, the distance between the tips of the individual opposite needle-shaped electrodes 4 of the two electrode-carrying heads 1 and 2 is the same for all the pairs of electrodes and corresponds to the optimum value.

During the operation of the electrostatic perforating device the progressive wear of the needle-shaped electrodes 4 and the resulting progressive increase of the distance between the facing ends of the opposite electrodes are compensated for automatically—before effecting a new restoration of the right distance as described above by means of a gauged shim 23—by lowering the upper electrode-carrying head 2 through a micrometric movement, either continuous or preferably discontinuous, by rotating the cam 21 by means of the motor 22, said cam causing—due to its decreasing radius sector—a proportional downward movement of the skid 12. In order to obtain this automatic compensation, the micrometric downward movement of the upper electrode-carrying head 2 corresponds to the progressive wear of the electrodes 4. This wear is, in turn, proportional to the current passing through said electrodes and, therefore, is equal to the power applied on the electrodes multiplied by the corresponding time. The calculaton is thus possible of how much an electrode is shortened or collapsed for each desired value of permeability of the web 3 subjected to electrostatic perforation, such value corresponding to the applied power (Kw), and for each hour of operation of the electrostatic perforating device. As a consequence, after a period of time permitting the passage of an amount of current that will cause a pre-established wear of the electrodes, the upper electrode-carrying head 2 will be lowered by a corresponding amount.

The electrostatic perforating device described above is used to perforate a web 3 made of covering material wherefrom junction bands will be then cut sequentially to be wrapped each around the abutting ends of two aligned cigarettes and around a double filter interposed between said ends of the two cigarettes, so as to join said cigarettes to the double interposed filter. The two cigarettes are then severed by a transverse cut in the middle of the double interposed filter, that is at the center of the junction band. The arrangement is such that the perforation formed in the web 3 by a row of opposite electrodes 4 will be located on one half of said band and, therefore, on one of the filter-tipped cigarettes obtained by said cut in the middle of the double filter, while the perforation formed in the web 3 by the other row of pairs of electrodes 4 will be located on the other half of said band and, therefore, on the other filter-tipped cigarette obtained by said cut in the middle of the double filter. The ventilation characteristics of the two filter-tipped cigarettes obtained by said cut in the middle of the double interposed filter may be different. Therefore, each row of the two rows of opposite electrodes 4 of the two electrode-carrying heads 1, 2 is fed by an independent high voltage generator, and the electric characteristics (voltage, number of cycles, frequency of cycles) of these two generators may be regulated separately.

Figure 4:
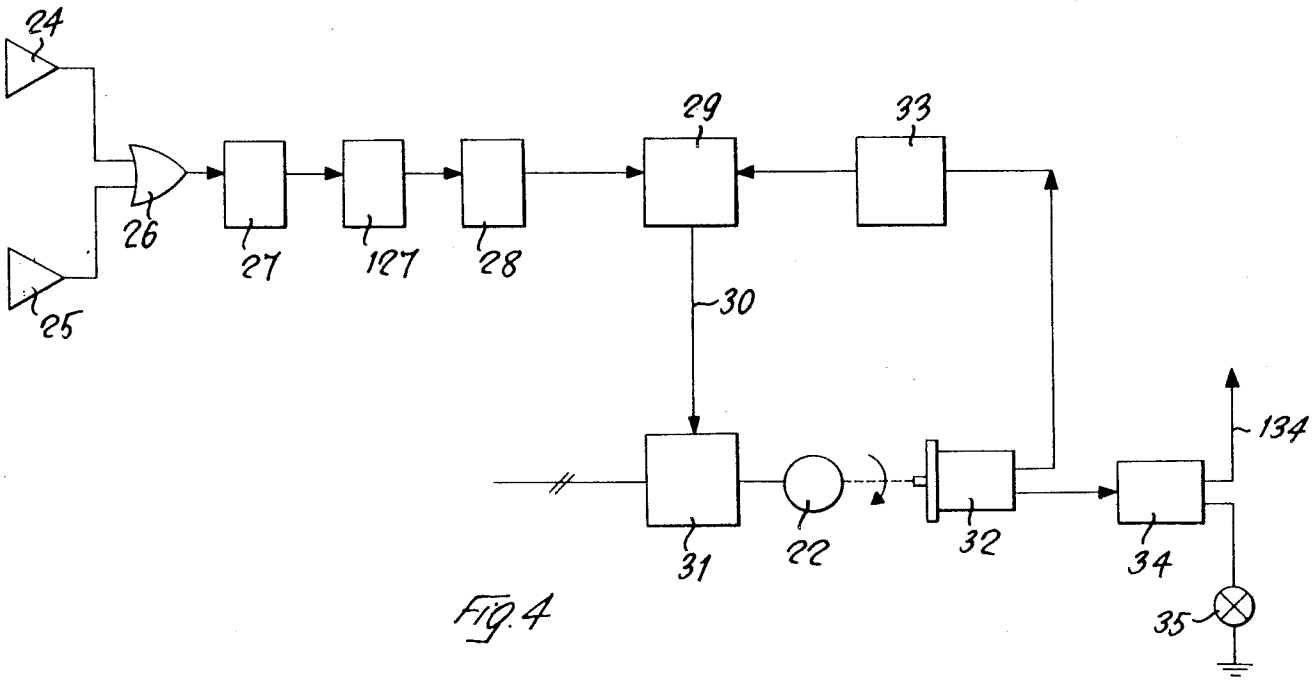
FIG. 4 is the diagram of an electric control circuit of the electrode perforating device of FIGS. 1 to 3.

In this case of two independent generators and different characteristics of the current fed to the two rows of pairs of opposite electrodes, in order to obtain an electric signal corresponding to the average value of the total power passed through the electrostatic perforator, for the purpose of determining the wear of the front ends of the electrodes 4 and then the corresponding micrometric compensation lowering movement of the upper electrode-carrying head 2 by means of the cam 21, the circuit shown in FIG. 4 may be used.

In this circuit, the two amplifiers 24 and 25 will emit pilot signals corresponding to the energy passed through the two rows of pairs of opposite electrodes 4. These signals will be fed to an adding circuit 25. The signal fed to the latter is sent to the frequency dividers 27, 127 which are cascade-connected for reasons of counting capacity. The signal of count termination causes, through a monostable circuit 28, the change of status of a flip-flop circuit 29 the output 30 of which causes, through the static switch 31, the feeding and, therefore, the rotation of the motor 22 actuating the cam 21. The sector of the cam 21, whereon the skid 12 is now resting through the idle roller 14, has a constantly decreasing radius. The rotation of the motor 22 and cam 21 is checked by a detector 32 of the angular displacement which is connected, for example through a gearing (not shown) to the shaft mounting said cam 21. The pulses generated by the detector 32 will be sent to a counter 33 which—when the cam 21 has effected a pre-established angular displacement—feeds to the flip-flop circuit 29 a reset signal to the preceding status, and thus brings the motor 22 to a stop.

The micrometric, automatic and intermittent lowering movement of the upper electrode-carrying head 2 as a function of the power passing through the electrostatic perforating device, in case both rows of pairs of opposite electrodes 4 are fed by a single high voltage generator, may be controlled by a circuit similar to that shown in FIG. 4, simplified as obvious to those skilled in the art and operating similarly.

In both cases, the micrometric automatic lowering cycle of the upper electrode-carrying head 2 is repeated until the distance between the two electrode-carrying head 1 and 2 permits the passage of the web 3 with a sufficient tolerance. When the minimum limit of the distance between the two electrode-carrying heads 1, 2 is reached, the detector 32 emits a pulse toward the circuit 34 which, through its output 134, will stop the operation of the electrostatic perforating device, while activating a warning device, for example by turning on a warning lamp 35, to require the resetting of the right distance between the electrodes 4 by the aid of the gauged shim 23.

What we claim is:

1. A device for electrostatic perforation of a web, comprising:

a first electrode-carrying head; and a second electrode-carrying head spaced apart from said first head to permit said web to pass between said heads along a path having a portion thereof lying in a plane, said second electrode-carrying head including an electrode support, a plurality of needle-shaped electrodes having axes and discharge ends, said electrodes being slidably mounted to said electrode support with their discharge ends extending toward said first electrode-carrying head and with their axes substantially perpendicular to said plane, said electrodes being slidable in the direction of their axes, and adjustment means for exerting a pushing force on said electrodes to force the discharge ends thereof toward said first head so that a predetermined electrode spacing can be achieved when said web is replaced by a gauged shim and said discharge ends are pushed against said shim, said adjustment means additionally including restraining means for exposing said electrodes to an opposing force as they are being pushed, wherein said electrode support has a plurality of bores, each electrode being disposed in a respective bore, wherein said electrodes have rear ends, and wherein said adjustment means includes, for each electrode, an electrode-carrying clamp disposed in the respective bore and frictionally engaging the electrode, and a piston slidably disposed in the respective bore, the piston having a first side disposed adjacent the rear end of the electrode and a second side for exposure to pressurized fluid.

2. The device of claim 1, wherein said web comprises paper for the manufacture of ventilated cigarettes.

3. The device of claim 1, wherein said first electrode-carrying head comprises a common plate-shaped electrode.

4. The device of claim 1, wherein said first electrode-carrying head comprises a further support and a further plurality of needle-shaped electrodes mounted thereon, each further needle-shaped electrode having an axis and being disposed co-axially with respect to a respective one of said needle-shaped electrodes of said second electrode-carrying head.

5. The device of claim 11, wherein said restraining means comprises means acting separately on said electrodes for exerting frictional resistance.

6. The device of claim 1, further comprising additional adjustment means connected to at least one of said heads for progressively reducing the distance between said heads during operation of said device to automatically compensate for electrode wear.

7. The device of claim 6, wherein one of said heads is stationary, and wherein said additional adjustment means comprises mounting means for mounting the other of said heads for movement toward and away from said stationary head along a line substantially parallel to the axes of said electrodes, said other of said heads being biassed toward said stationary head; a motor having a shaft; and a cam mounted on said shaft, said mounting means having a portion thereof resting against said cam, said cam being configured to vary the position of said mounting means when said shaft is rotated through an angle in order to reduce the distance between said heads.

8. The device of claim 6, wherein one of said heads is stationary, and wherein said additional adjustment means comprises a skid mounted for movement along a line substantially parallel to the axes of said electrodes; means for mounting the other of said heads to said skid; a rotatably mounted element having an eccentrically disposed crank; a resiliently collapsible telescopic connecting rod operatively connected between said skid and said crank; an idle roller rotatably mounted on said skid; and a rotatably mounted cam positioned for engagement by said idle roller.

9. The device of claim 6, wherein said additional adjustment means further comprises means responsive to a predetermined minimum distance between said heads for discontinuing operation of said device when said minimum distance is reached.

10. The device of claim 6, wherein said additional adjustment means further compries means responsive to a predetermined minimum distance between said heads for activating a warning signal when said minimum distance is reached.

11. The device of claim 6, wherein said additional adjustment means comprises means for reducing said distance as a function of the total power passed through said device during a predetermined period of time.

12. A device for electrostatic perforation of a web, comprising:

a first electrode-carrying head;

a second electrode-carrying head spaced apart from said first head to permit said web to pass between said heads along a path having a portion thereof lying in a plane, said second electrode-carrying head including an electrode support, a plurality of needle-shaped electrodes having axes and discharge ends, said electrodes being slidably mounted to said electrode support with their discharge ends extending toward said first electrode-carrying head and with their axes substantially perpendicular to said plane, said electrodes being slidable in the direction of their axes, and adjustment means for exerting a pushing force on said electrodes to force the discharge ends thereof toward said first head so that a predetermined electrode spacing can be achieved when said web is replaced by a gauged shim and said discharge ends are pushed against shim, said adjustment means additionally including restraining means for exposing said electrodes to an opposing force as they are being pushed; and additional adjustment means connected to at least one of said heads for progressively reducing the distance between said heads during operation of said device to automatically compensate for electrode wear.

13. The device of claim 12, wherein said web comprises paper for the manufacture of ventilated cigarettes.

14. The device of claim 12, wherein said first electrode-carrying head comprises a common plate-shaped electrode.

15. The device of claim 12, wherein said first electrode-carrying head comprises a further support and a further plurality of needle-shaped electrodes mounted thereon, each further needle-shaped electrode having an axis and being disposed co-axially with respect to a respective one of said needle-shaped electrodes of said second electrode-carrying head.

16. The device of claim 12, wherein said adjustment means comprises means acting separately on said electrodes for exerting said pushing force on said electrodes individually.

17. The device of claim 12, wherein said adjustment means comprises means for receiving pressurized fluid to exert said pushing force on individual electrodes.

18. The device of claim 12, wherein said restraining means comprises means acting separately on said electrodes for exerting frictional resistance.

19. The device of claim 12, wherein said electrode support has a plurality of bores, each electrode being disposed in a respective bore, wherein said electrodes have rear ends, and wherein said adjustment means comprises, for each electrode, an electrode-carrying clamp disposed in the respective bore and frictionally engaging the electrode, and a piston slidably disposed in the respective bore, the piston having a first side disposed adjacent the rear end of the electrode and a second side for exposure to pressurized fluid.

20. The device of claim 12, wherein one of said heads is stationary, and wherein said additional adjustment means comprises mounting means for mounting the other of said heads for movement toward and away from said stationary head along a line substantially parallel to the axes of said electrodes, said other of said heads being biased toward said stationary head; a motor having a shaft; and a cam mounted on said shaft, said mounting means having a portion thereof resting against said cam, said cam being configured to vary the position of said mounting means when said shaft is rotated through an angle in order to reduce the distance between said heads.

21. The device of claim 12, wherein one of said heads is stationary, and wherein said additional adjustment means comprises a skid mounted for movement along a line substantially parallel to the axes of said electrodes; means for mounting the other of said heads to said skid; a rotatably mounted element having an eccentrically disposed crank; a resiliently collapsible telescopic connecting rod operatively connected between said skid and said crank; an idle roller rotatably mounted on said skid; and a rotatably mounted cam positioned for engagement by said idle roller.

22. The device of claim 12, wherein said additional adjustment means further comprises means responsive to a predetermined minimum distance between said heads for discontinuing operation of said device when said minimum distance is reached.

23. The device of claim 12, wherein said additional adjustment means further comprises means responsive to a predetermined minimum distance between said heads for activating a warning signal when said minimum distance is reached.

24. The device of claim 12, wherein said additional adjustment means comprises means for reducing said distance as a function of the total power passed through said device during a predetermined period of time.

* * * * *